United States Patent [19]

Lehtinen

[11] 3,981,768

[45] Sept. 21, 1976

[54] WEB-FORMING METHOD AND APPARATUS FOR PAPER-MANUFACTURING MACHINES

[75] Inventor: Antti Lehtinen, Jyvaskyla, Finland

[73] Assignee: Valmet Oy, Finland

[22] Filed: Dec. 3, 1974

[21] Appl. No.: 529,112

[30] Foreign Application Priority Data

Dec. 5, 1973 Finland ..... 3751/73

[52] U.S. Cl. ..... 162/199; 162/207; 162/275; 162/310

[51] Int. Cl.[2] ..... D21F 1/32

[58] Field of Search ..... 162/275, 310, 207, 208, 162/199, 212, 213, 214, 215, 216, 322, 324, 317

[56] References Cited

UNITED STATES PATENTS

| | | | |
|---|---|---|---|
| 1,395,219 | 10/1921 | Bennett | 162/275 |
| 2,714,081 | 7/1955 | Burgon | 154/101 |
| 3,037,706 | 6/1962 | Dupasquier | 162/207 |

*Primary Examiner*—Arthur D. Kellogg
*Attorney, Agent, or Firm*—Steinberg & Blake

[57] ABSTRACT

A web-forming method and apparatus to be used in the manufacture of paper. A web is formed at one side of a travelling wire while at the opposite side thereof, from a location in close proximity thereto, jets of steam are directed toward the wire to produce an implosion at the opposite side of the wire, as well as directly in the wire and in the web. The jets of steam issue from openings in the wall of an enclosure which is situated in close proximity to the said opposite side of the wire, this enclosure having in its interior steam which issues through the openings to form the jets. A plurality of these enclosures may form part of a forming board, and also one or more of the enclosures may be situated along the wire at a part thereof which has travelled beyond the forming board.

8 Claims, 2 Drawing Figures

WEB-FORMING METHOD AND APPARATUS FOR PAPER-MANUFACTURING MACHINES

BACKGROUND OF THE INVENTION

The present invention relates to methods and apparatus for manufacturing paper.

In particular, the present invention relates to web-forming methods and apparatus used in the manufacture of paper.

As is well known, it is conventional to deliver from a headbox stock which is deposited at one side of a travelling wire to form at this one side of the wire a web while the travelling wire is supported by various supporting members which in addition to supporting the wire serve to dewater the web through the wire.

While many attempts have been made to develop wiresupporting members of the above type which are of the greatest possible efficiency, nevertheless the desired results have not yet been fully achieved. The reason for this is in particular the fact that the openings in the wire are plugged at the very beginning of the dewatering stage by fibers which become situated in the pores or openings of the wire. As a result of the plugging of the wire by the fibers, the escape of water from the upper layers of the web is impeded. The dewatering action has been enhanced by utilizing suction boxes placed under the wire, but the desired results have not been achieved through such expedients. A further disadvantage has been encountered from the fact that the wire is subjected to considerable wear and tear as a result of the use of numerous wire-supporting units, this undesirable wear and tear of the wire resulting from the friction between the wire and the units supporting the same.

SUMMARY OF THE INVENTION

It is accordingly a primary object of the present invention to provide a method and apparatus which will avoid the above drawbacks.

Thus, it is an object of the present invention to provide a method and apparatus which will reduce considerably the friction between the wire and the members supporting the same.

In addition, it is an object of the present invention to provide a method and apparatus which will effectively produce a homogeneous stock web while promoting the dewatering of the stock web.

According to the method of the invention, at the side of the wire which is opposite to the web a plurality of small jets of steam are directed toward the wire from a location in close proximity thereto. For this purpose a steam-supply means in the form of a hollow enclosure is situated at this opposite side of the wire. The enclosure has in close proximity to the wire a wall formed with small openings through which steam in the enclosure can issue toward the wire. Thus, the enclosure has a porous contact face which may be located against the wire, and the steam which is thus conducted toward the wire will produce implosion phenomena next to the wire as well as in the perforations of the wire and in the stock which forms at the side of the wire opposite to the means for supplying the steam jets. Preferably the wall of the enclosure which faces the wire consists of a sintered porous material. The implosion provided according to the invention may be produced between the forming board and the wire in order to achieve a homogeneous stock web and to promote the dewatering of the stock web. Also the implosion may be applied to the wire subsequent to the forming board in order to clean the wire and enhance the dewatering action.

Thus, the present invention is based on the utilization of an implosion phenomenon. In order to achieve this action, steam is conducted toward the wire through the members which support the wire. The steam forms bubbles in the film of water which is situated between the wire and the support members, these bubbles forming not only in the water film at the underside of the wire but also in the perforations of the wire and in the stock web. In the cold, flowing water film the steam bubbles condense with a rapid implosion, producing pressure pulses in the wire and in the web. As a result the pores of the wire which may be plugged by fibers are cleaned out and dewatering through the wire is enhanced. Moreover any friction between the wire and the supporting members is reduced inasmuch as a steam film is produced between the support members and the wire while at the same time the wire vibrates because of the effect of the pressure pulses.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
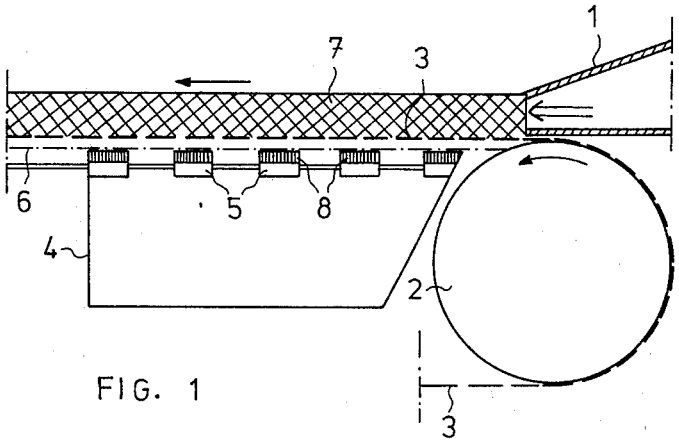
FIG. 1 is a schematic side elevation illustrating one embodiment of the invention at the region where stock issues from a headbox.

Referring now to FIG. 1, pulp stock issues in a known way from the slice portion 1 of a headbox toward the left, in the direction of the arrow shown in FIG. 1 at the slice of the headbox. The stock which issues in this way is deposited onto the wire 3 which is transported by and guided around the breast roll 2. In this way the stock web 7 forms on the wire 3. The wire 3 at the location where it travels beyond the breast roll 2 moves while being supported by a forming board 4. The upper part of the forming board 4 is provided with a plurality of wire-supporting members 5 each of which forms a means for supplying small jets of steam to the side of the wire which is opposed to the web 7 which forms thereon and from a location which is in close proximity to this side of the wire which is opposite to the side where the web 7 is located.

The water which flows through the openings of the wire forms beneath the latter a water film 6 which is indicated in the drawings. The steam-supply means 5 are in the form of enclosures of rectangular cross section which extend across the entire width of the wire. These enclosures 5 have at their walls 8 which face the wire 3 a sintered porous material which may be metal, plastic, ceramic, or the equivalent thereof, and these porous sintered walls 8 may be formed with small openings or slits through which steam in the interior of the enclosures 5 will issue in the form of jets, for example, toward the wire 3.

Thus, the steam will discharge through the sintered walls 8 into the water film 6 at the side of the wire opposed to the web 7, and in addition the steam will have access to the perforations of the wire and to the stock web 7. Thus, steam bubbles will form in the film 6, in the perforations of the wire 3, and in the web 7. As a result of the influence of the cold, moving film of water the bubbles of steam condense with a rapid implosion. These implosions give rise to pressure pulses which shake the wire 3. Under the effect of this shaking the pores of the wire become cleaned, so that the dewatering action is enhanced. The implosion also produces pressure pulses in the stock which forms the web at the side of the wire opposite to the means 5, and as a result the formation of a homogeneous stock web 7 is promoted.

Figure 2:
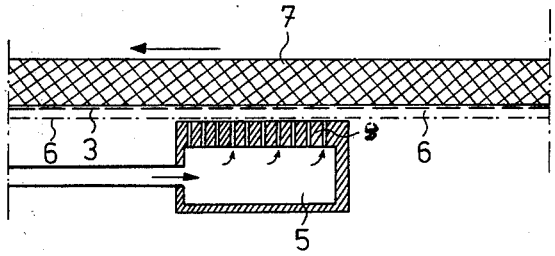
FIG. 2 is a schematic illustration of the method and apparatus of the invention at a location beyond a forming board which is shown in FIG. 1.

In FIG. 2 there is illustrated a part of the wire 3 which has travelled beyond the forming board 4. This wire 3 of course travels together with the web 7 which forms on the wire 3. Beyond the forming board the wire 3 is supported by the illustrated means 5 in the form of a steam enclosure situated beneath the wire and having the porous sintered wall 8 which is formed with the openings through which the small jets of steam issue. At this location also there is a film of water 6 beneath the wire. The hollow interior of the enclosure 5 is supplied with steam from any suitable source through a pipe which is shown at the lower left of FIG. 2, and a similar pipe extends to the left means 5 of FIG. 1 and between the several means 5 of FIG. 1 so that in this way all of these enclosures 5 of FIG. 1 are supplied with the steam which issues through the openings of the walls 8.

Thus, in the case of FIG. 2 also steam will discharge from the wall 8 of the supporting member into the water film 6 at the underside of the wire. In this way bubbles are formed in the water film as well as in the wire perforations and in the stock web 7. These bubbles condense with a rapid implosion because the film of water and the stock are much colder than the steam and are in motion. Thus the implosion which is achieved will produce pressure pulses. As a result of these pressure pulses the pores of the wire are cleaned and the dewatering action is enhanced and the time required for dewatering is reduced.

Of course, the invention is not confined to the specific embodiments shown in the drawings and described above. These may be modified within the scope of the invention. For example, the wire supporting members may also have configurations other than those shown in the drawings and described above.

What is claimed is:

1. In a paper manufacturing method, the steps of situating stock which issues from a headbox against one side of a travelling wire to form a web at said one side of said wire and a film of liquid at said wire, and simultaneously directing a plurality of small jets of steam toward the opposite side of the wire, which is opposed to said one side thereof, from a location which is in close proximity to said opposite side of said wire, in a manner creating in said film small steam bubbles which implode to provide an implosion action at said opposite side of the wire, in the wire, and in the web which forms at said one side of the wire.

2. In a method as recited in claim 1, a forming board being situated at said opposite side of the wire, and wherein the jets of steam are directed toward said opposite side of the wire at the location where the wire travels along the forming board, to promote the formation of a homogeneous stock web and to enhance the dewatering of the stock.

3. In a method as recited in claim 1, a forming board being situated at said opposite side of the wire, and wherein said jets of steam are provided at a location beyond said forming board for engaging the wire at a part thereof situated beyond the forming board for cleaning the wire and increasing the dewatering action.

4. In a paper manufacturing machine, travelling wire means for forming on one side of said wire means from stock delivered from a headbox to said one side of said wire means, a web and a film of liquid situated at said wire means, and means at the opposite side of said wire means, in close proximity thereto, for directing jets of steam toward said opposite side of said wire means in a manner creating in said film of liquid small steam bubbles which due to the lesser temperature of the film of liquid, as compared with the temperature of the steam bubbles, implode to subject the web and wire means to implosion action.

5. The combination of claim 4 and wherein said means at said opposite side of said wire means includes an enclosure having in close proximity to said wire means a wall formed with a plurality of small openings through which steam in the enclosure flows in the form of small jets toward said wire means and the web engaging said one side thereof.

6. The combination of claim 5 and wherein said wall of said enclosure is made of a sintered material.

7. The combination of claim 5 and wherein a forming board is situated along said opposite side of said wire means, said forming board carrying a plurality of said enclosures which are distributed along said wire means.

8. The combination of claim 5 and wherein a forming board cooperates with said opposite side of said wire means, said enclosure being situated beyond said forming board.

* * * * *